US006860245B2

(12) United States Patent
Hosoya

(10) Patent No.: US 6,860,245 B2
(45) Date of Patent: Mar. 1, 2005

(54) CONTROL APPARATUS OF VARIABLE VALVE TIMING MECHANISM AND METHOD THEREOF

(75) Inventor: Hajime Hosoya, Atsugi (JP)

(73) Assignee: Hitachi Unisia Automotive, Ltd., Atsugi (JP)

( * ) Notice: Subject to any disclaimer, the term of this patent is extended or adjusted under 35 U.S.C. 154(b) by 0 days.

(21) Appl. No.: 10/335,926

(22) Filed: Jan. 3, 2003

(65) Prior Publication Data

US 2003/0131812 A1 Jul. 17, 2003

(30) Foreign Application Priority Data

Jan. 16, 2002 (JP) ..... 2002-007921

(51) Int. Cl.[7] ..... F01L 1/34

(52) U.S. Cl. ..... 123/90.15; 123/90.16; 123/90.17

(58) Field of Search ..... 123/90.16, 90.15, 123/90.13, 90.31

(56) References Cited

U.S. PATENT DOCUMENTS 5,195,470 A * 3/1993 Ikeura ..... 123/90.15
6,502,537 B2 * 1/2003 Todo et al. ..... 123/90.17
2002/0029757 A1 * 3/2002 Ogawa et al. ..... 123/295

FOREIGN PATENT DOCUMENTS

JP 2001-041013 2/2001

* cited by examiner

*Primary Examiner*—Thomas Denion
*Assistant Examiner*—Zelalem Eshete
(74) *Attorney, Agent, or Firm*—Foley & Lardner LLP

(57) ABSTRACT

In a variable valve timing mechanism that changes a rotation phase of a camshaft with respect to a crankshaft by a braking force of an electromagnetic brake to vary valve timing of engine valves, a controlled variable of the electromagnetic brake is corrected according to an engine rotation speed and a valve lift amount, that are correlative to an input torque from a camshaft side to the variable valve timing mechanism.

20 Claims, 13 Drawing Sheets

CONTROL APPARATUS OF VARIABLE VALVE TIMING MECHANISM AND METHOD THEREOF

FIELD OF THE INVENTION

The present invention relates to a control apparatus and a control method of a variable valve timing mechanism that varies valve timing of engine valves (intake valve/exhaust valve).

RELATED ART OF THE INVENTION

Heretofore, there has been known a variable valve timing mechanism in which an assembling angle between a driving rotor on a crankshaft side and a driven rotor on a camshaft side is changed by an assembling angle adjusting mechanism (refer to Japanese Unexamined Patent Publication No. 2001-041013).

The assembling angle adjusting mechanism of the variable valve timing mechanism disclosed in Japanese Unexamined Patent Publication No. 2001-041013 is provided with a link arm having, on one end thereof, a rotating portion rotatably connected to the driven rotor and also having, on the other end thereof, a sliding portion connected to be slidable in radial by a radial guide disposed on the driving rotor.

Then, with the radial transfer of the sliding portion, a position of the rotating portion is relatively displaced circumferentially, so that the assembling angle between the driving rotor and the driven rotor is relatively changed.

The radial transfer of the sliding portion is performed by relatively rotating, by a braking force of an electromagnetic brake, a guide plate that is formed with a spiral guide groove with which the sliding portion of the link arm is fitted.

In the variable valve timing mechanism of the above constitution, an input torque from the camshaft side acts on the sliding portion of the link arm so that the sliding portion is pressed to an outer periphery side of the spiral guide groove.

Therefore, a load torque of the electromagnetic brake of when relatively rotating the guide plate is changed by the input torque from the camshaft side.

Consequently, there has been a problem in that a response characteristic in valve timing control is changed due to the input torque from the camshaft side.

SUMMARY OF THE INVENTION

It is therefore an object of the present invention to enable a control of valve timing with a desired response characteristic without being affected by an input torque from a camshaft side.

In order to accomplish the above-mentioned object, the present invention is constituted so that a controlled variable of an electromagnetic brake is corrected according to an input torque from a camshaft side to a variable valve timing mechanism.

The other objects and features of the invention will become understood from the following description with reference to the accompanying drawings.

DESCRIPTION OF THE PREFERRED EMBODIMENT

Figure 1:
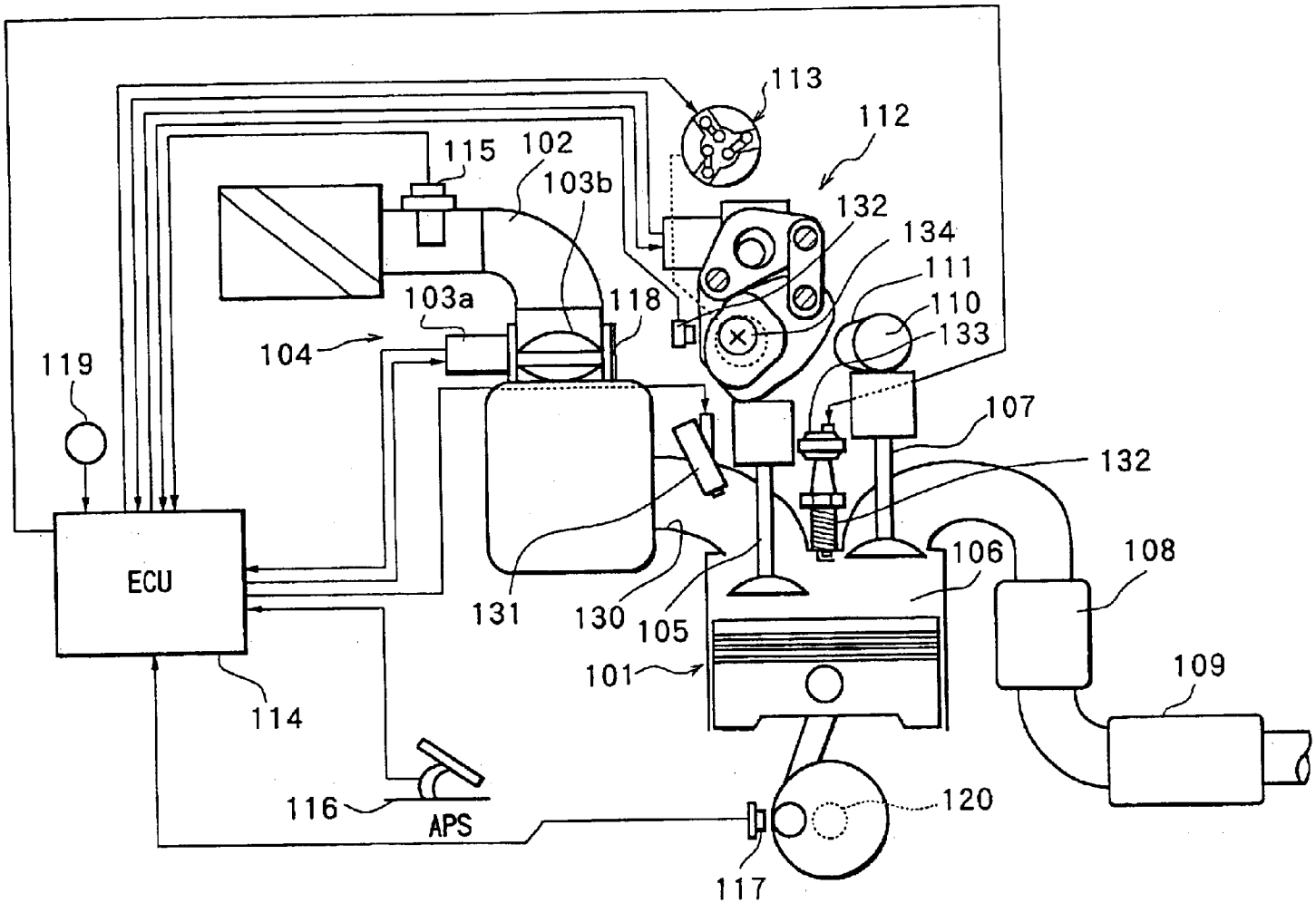
FIG. 1 is a diagram of a system structure of an engine in an embodiment.

FIG. 1 is a structural diagram of an engine for vehicle in an embodiment.

In an intake passage 102 of an engine 101, an electronically controlled throttle 104 is disposed for driving a throttle valve 103*b* to open and close by a throttle motor 103*a*.

Air is sucked into a combustion chamber 106 via electronically controlled throttle 104 and an intake valve 105.

A combusted exhaust gas of engine 101 discharged from combustion chamber 106 via an exhaust valve 107 is purified by a front catalyst 108 and a rear catalyst 109, and then emitted into the atmosphere.

Exhaust valve 107 is driven by a cam 111 axially supported by an exhaust side camshaft 110, to open and close at fixed valve lift amount, valve operating angle and valve timing.

A valve lift amount of intake valve 105 is varied continuously by a variable valve lift mechanism 112, and valve timing thereof is varied continuously by a variable valve timing mechanism 113.

Further, a fuel injection valve 131 is disposed on an intake port 130 at the upstream side of intake valve 105 for each cylinder.

Fuel injection valve 131 injects fuel adjusted at a predetermined pressure toward intake valve 105, when driven to open by an injection pulse signal.

An air-fuel mixture formed inside each cylinder is ignited to burn by a spark ignition by an ignition plug 132.

Each ignition plug 132 is provided with an ignition coil 133 incorporating therein a power transistor.

An engine control unit (ECU) 114 incorporating therein a microcomputer receives various detection signals from an air flow meter 115 detecting an intake air amount Q of engine 101, an accelerator opening sensor APS 116 detecting an accelerator opening APO, a crank angle sensor 117 detecting a rotation angle of a crankshaft 120, a throttle sensor 118 detecting an opening TVO of throttle valve 103*b*, a water temperature sensor 119 detecting a cooling water temperature Tw of engine 101, a cam sensor 132 detecting a rotation angle of an intake side camshaft 134, and the like.

Engine control unit 114 controls electronically controlled throttle 104, variable valve lift mechanism 112 and variable valve timing mechanism 113, to control an intake air amount of engine 101.

Further, engine control unit 114 outputs the injection pulse signal to fuel injection valve 131 to control an air-fuel ratio, and further, switching controls the power transistor to control ignition timing of ignition plug 132.

Next, a constitution of variable valve timing mechanism 113 will be described based on FIGS. 2 to 5.

Variable valve timing mechanism 113 comprises camshaft 134, a drive plate 2, an assembling angle adjusting mechanism 4, an operating apparatus 15 and a cover 6.

Drive plate 2 is transmitted with the rotation of crankshaft 120 to be rotated.

Assembling angle adjusting mechanism 4 is the one that changes an assembling angle between camshaft 134 and drive plate 2, and is operated by operating apparatus 15.

Cover 6 is mounted across a cylinder head (not shown in the figures) and a front end of a rocker cover, to cover front surfaces of drive plate 2 and assembling angle adjusting mechanism 4.

A spacer 8 is fitted with a front end (left side in FIG. 2) of camshaft 134.

The rotation of spacer 8 is restricted with a pin 80 that is inserted through a flange portion 134*f* of camshaft 134.

Camshaft 134 is formed with a plurality of oil galleries in radial.

Spacer 8 is formed with a latch flange 8*a* of disk shaped, a cylinder portion 8*b* extending axially from a front end surface of latch flange 8*a*, and a shaft supporting portion 8*d* extending in three-ways to an outer diameter direction of spacer 8 from a base end side of cylinder portion 8*b*, that is, the front end surface of latch flange 8*a*.

Shaft supporting portion 8*d* is formed with press fitting holes 8*d* that are arranged circumferentially in each 120° and also parallel to an axial direction.

Further, spacer 8 is formed with a plurality of oil galleries 8*r* in radial.

Drive plate 2 has a disk shape formed with a through hole 2*a* at a center thereof, and is mounted to spacer 8 so as to be relatively rotated in a state that the axial displacement thereof is restricted by latch flange 8*a*.

Figure 3:
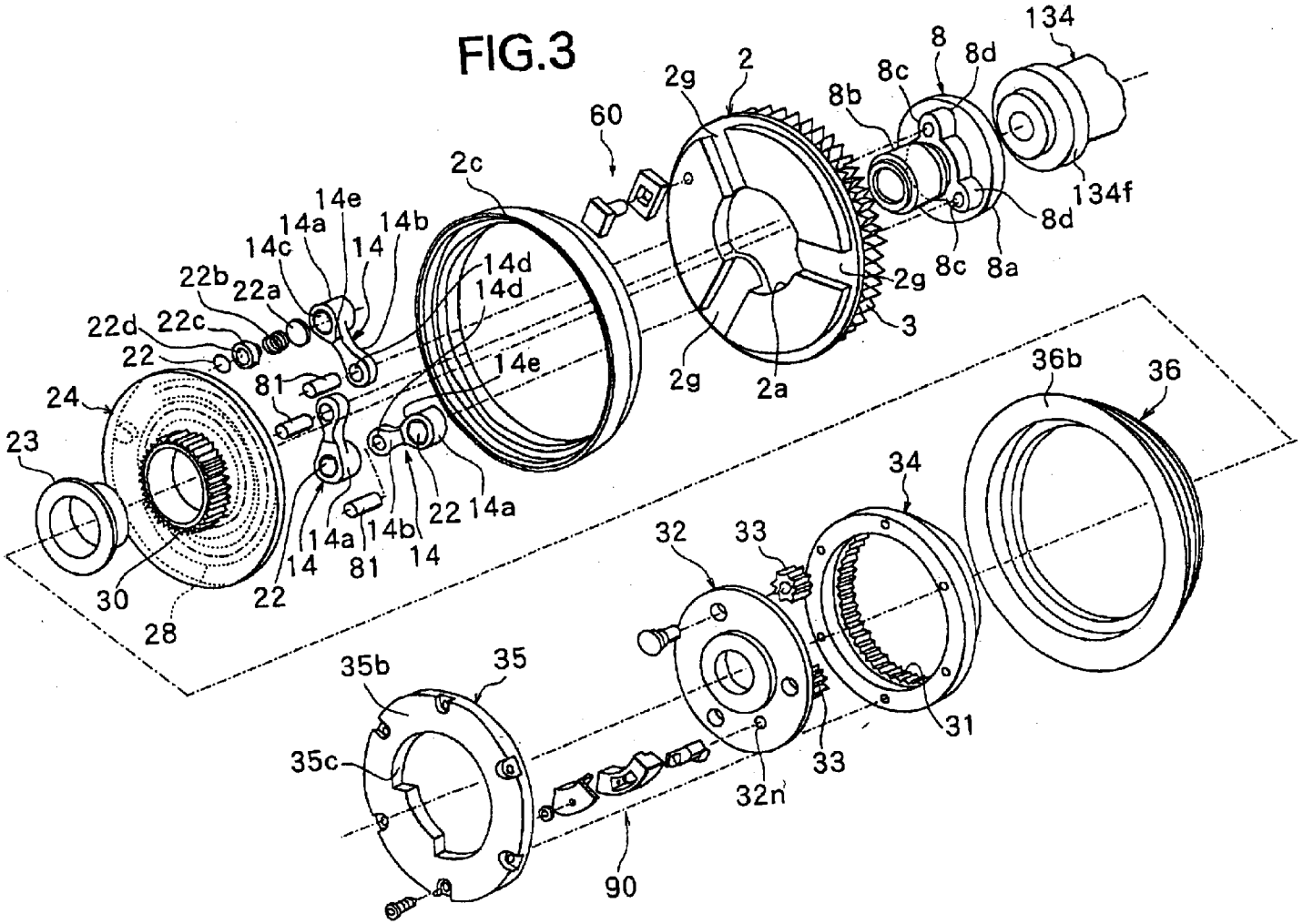
FIG. 3 is an exploded perspective view of the variable valve timing mechanism.

A timing sprocket that is transmitted with the rotation of crankshaft 120 via a chain (not shown in the figures) is formed on a rear outer periphery of drive plate 2, as shown in FIG. 3.

Further, on a front end surface of drive plate 2, three guide grooves 2*g* connecting through hole 2*a* with the outer periphery of drive plate 2 are formed at each 120°.

Moreover, to an outer periphery portion of the front end surface of drive plate 2, a cover member 2*c* of annular shaped is fixed by welding or press fitting.

In the above constitution, camshaft 134 and spacer 8 correspond to a driven rotor, and drive plate 2 inclusive of timing sprocket 3 corresponds to a driving rotor.

Above described assembling angle adjusting mechanism 4 changes a relative assembling angle between camshaft 134 and drive plate 2.

Assembling angle adjusting mechanism 4 includes three link arms 14, as shown in FIG. 3.

Each link arm 14 is provided with, at a tip portion thereof, a cylinder portion 14*a* as a sliding portion, and is provided with an arm portion 14*b* extending from cylinder portion 14*a* in an outer diameter direction.

A housing hole 14*c* is formed on cylinder portion 14*a*, while a rotation hole 14*d* as a rotating portion is formed on an base end portion of arm portion 14*b*.

Link arm 14 is mounted so as to be rotatable around a rotation hole 81, by inserting rotation hole 81 press fitted into a press fitting hole 8*c* of spacer 8 through rotation hole 14*d*.

On the other hand, cylinder portion 14*a* of link arm 14 is inserted into guide groove 2*g* (radial guide) of drive plate 2, to be mounted so as to be movable in radial with respect to drive plate 2.

In the above constitution, when cylinder portion 14*a* receives an outer force to displace in radial along guide groove 2*g*, rotation pin 81 transfers circumferentially by an angle according to a radial displacement amount of cylinder portion 14*a*, so that camshaft 134 is relatively rotated with respect to drive plate 2 due to the displacement of rotation pin 81.

Figure 4:
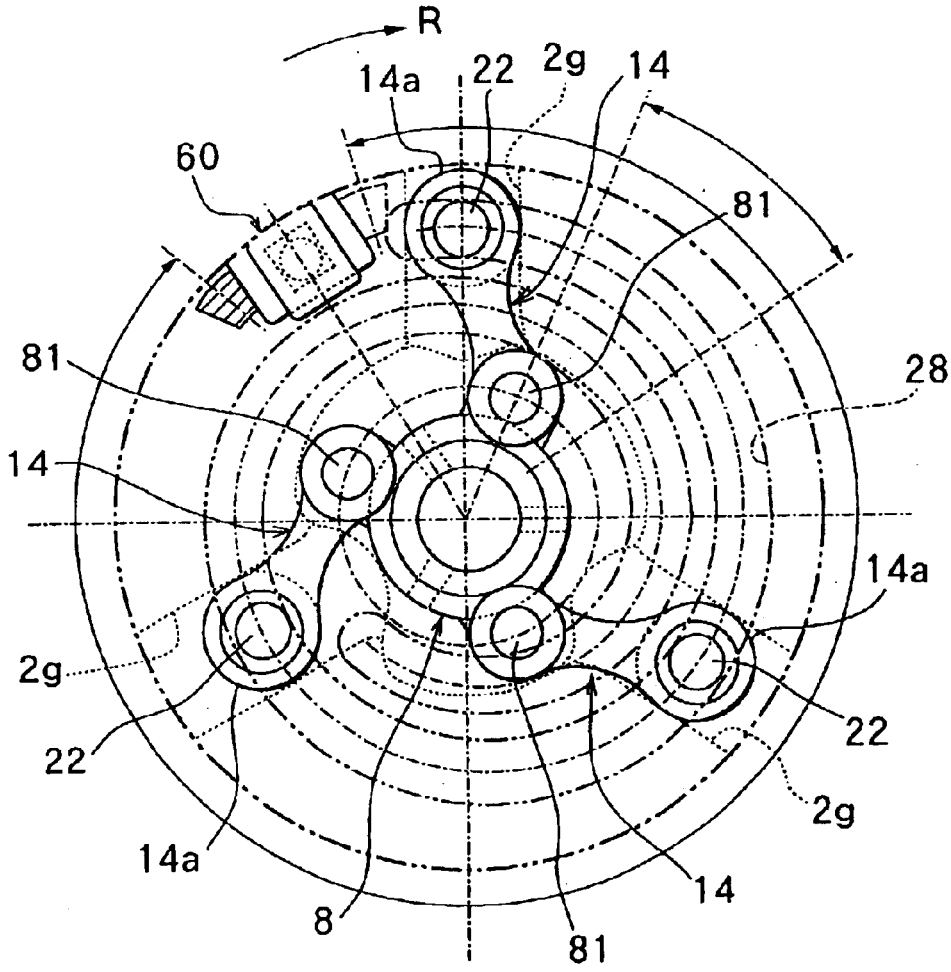
FIG. 4 is a cross section view showing an essential part of the variable valve timing mechanism.
Figure 5:
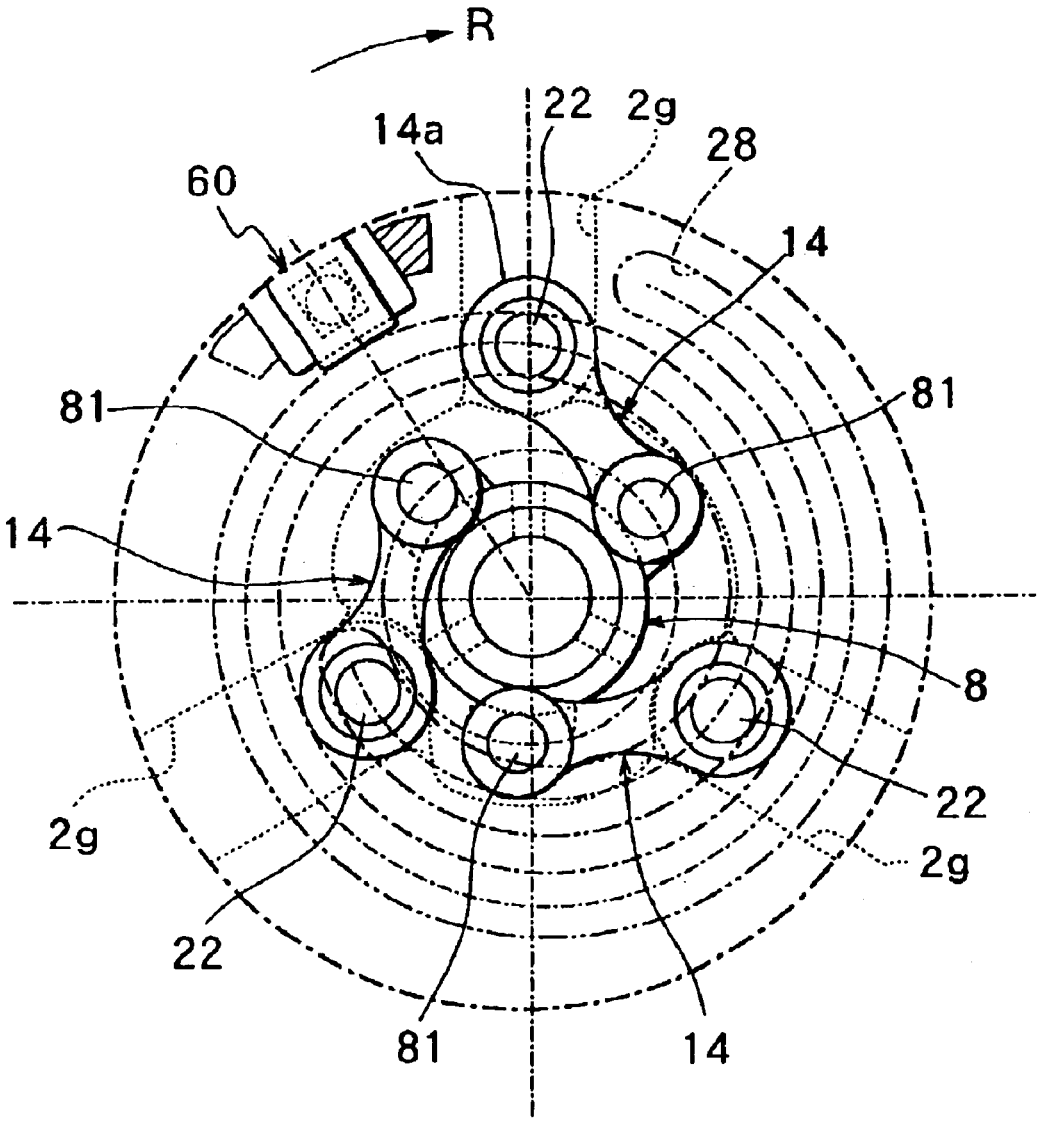
FIG. 5 is a cross section view showing the essential part of the variable valve timing mechanism.

FIGS. 4 and 5 show an operation of assembling angle adjusting mechanism 4.

As shown in FIG. 4, when cylinder portion 14*a* in guide groove 2*g* is arranged on an outer periphery side of drive plate 2, since rotation pin 81 on the base end portion is close to guide groove 2*g*, valve timing is in a most retarded state.

On the other hand, as shown in FIG. 5, when cylinder portion 14*a* in guide groove 2*g* is arranged on an inner periphery side of drive plate 2, since rotation pin 81 is pressed circumferentially to depart from guide groove 2*g*, the valve timing is in a most advance state.

The radial transfer of cylinder portion 14*a* in assembling angle adjusting mechanism 4 is performed by operating apparatus 15.

Operating apparatus 15 is provided with an operation conversion mechanism 40 and a speed increasing/reducing mechanism 41.

Operation conversion mechanism 40 is provided with a sphere 22 held in cylinder portion 14*a* of link arm 14, and a guide plate 24 coaxially formed so as to face the front face of drive plate 2, to convert the rotation of guide plate 24 into the radial displacement of cylinder portion 14*a* of link arm 14.

Guide plate 24 is supported so as to be relatively rotatable with respect to an outer periphery of cylinder portion 8*b* of spacer 8 via a metal bush 23.

On a rear face of guide plate 24, a spiral guide groove 28 having an approximately semicircular section is formed, and on an intermediate portion in a radial direction of guide plate 24, an oil gallery 24*r* for supplying oil is formed in a longitudinal direction.

Sphere 22 is fitted with spiral guide groove 28.

Figure 2:
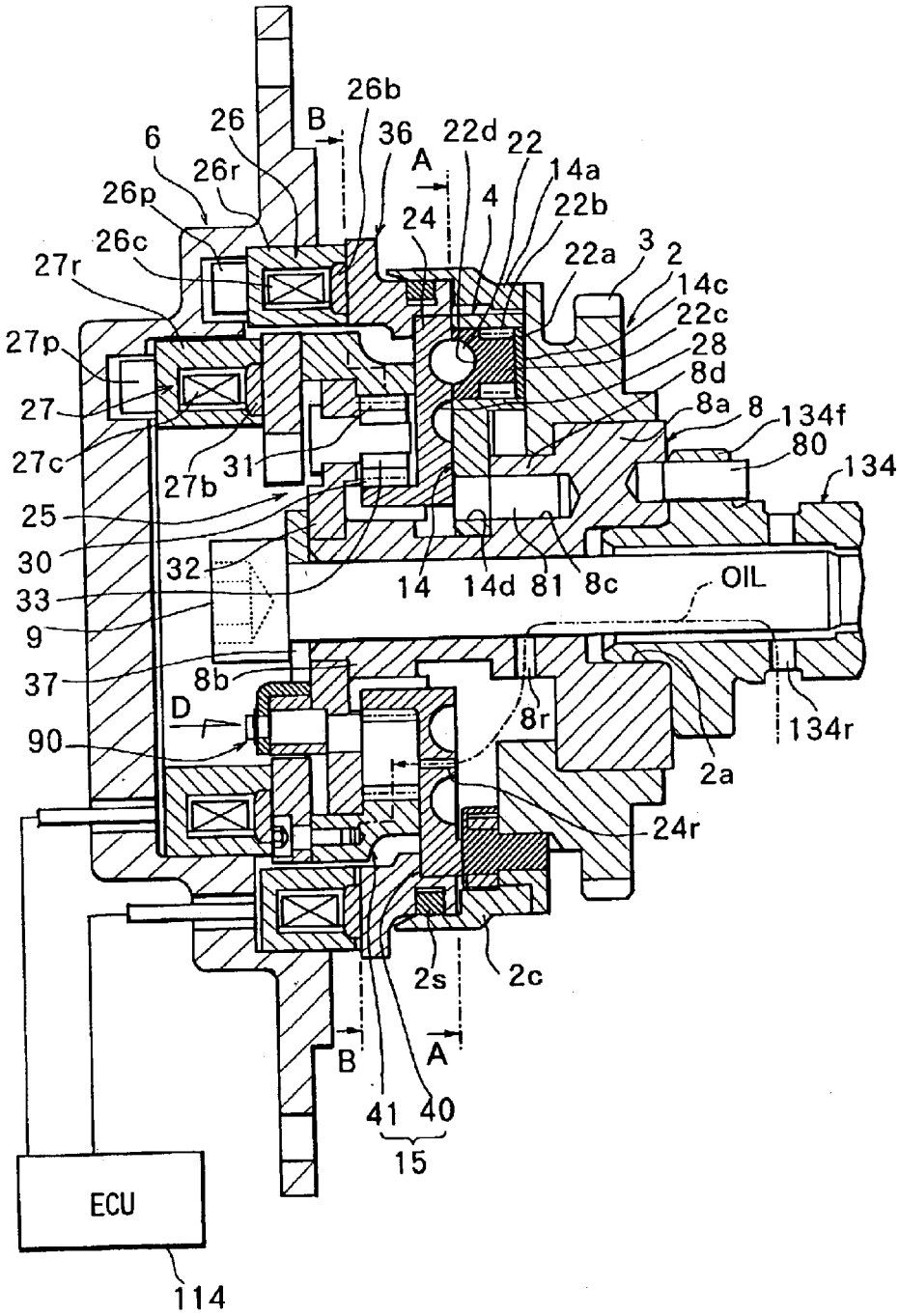
FIG. 2 is a cross section view showing a variable valve timing mechanism in the embodiment.

As shown in FIGS. 2 and 3, a supporting panel 22*a* of disk shaped, a coil spring 22*b*, a retainer 22*c* and sphere 22 are inserted in this sequence into housing hole 14*c* disposed to cylinder portion 14*a* of link arm 14.

Retainer 22*c* is formed, on a front end portion thereof, with a supporting portion 22*d* for supporting sphere 22 in a state where sphere 22 protrudes, and also formed, on an outer periphery thereof, with a flange 22*f* on which coil spring 22*b* is seated.

In an assembling condition as shown in FIG. 2, sphere 22 is fitted with spiral guide groove 28, and also is relatively rotatable in an extending direction of spiral guide groove 28.

Further, as shown in FIGS. 4 and 5, spiral guide groove 28 is formed so as to gradually reduce a diameter thereof along a rotation direction R of drive plate 2.

Accordingly, in operation conversion mechanism 40, if guide plate 24 is relatively rotated with respect to drive plate 2 in the rotation direction R in the state where sphere 22 is fitted with spiral guide groove 28, sphere 22 transfers in radial to an outside along spiral guide groove 28.

Thus, cylinder portion 14*a* moves in an outer diameter direction shown in FIG. 4, and rotation pin 81 connected with link arm 14 is dragged so as to become closer to guide groove 2*g*, so that camshaft 134 transfers in a retarded direction.

On the contrary, if guide plate 24 is relatively rotated with respect to drive plate 2 in an opposite direction to the rotation direction R from the above condition, sphere 22 transfers in radial to an inside along spiral guide groove 28.

Thus, cylinder portion 14*a* transfers in an inner diameter direction shown in FIG. 5, and rotation pin 81 connected with link arm 14 is pressed so as to depart from guide 2*g*, so that camshaft 134 transfers in an advance direction.

Speed increasing/reducing mechanism 41 will be described in detail.

Speed increasing/reducing mechanism 41 is for transferring guide plate 24 with respect to drive plate 2 in the rotation direction R (speed increasing) or for moving guide plate 24 with respect to drive plate 2 in an opposite direction to the rotation direction R (speed reducing), and is provided with a planetary gear mechanism 25, a first electromagnetic brake 26 and a second electromagnetic brake 27.

Planetary gear mechanism 25 is provided with a sun gear 30, a ring gear 31, and a planetary gear 33 engaged with the both gears 30 and 31.

As shown in FIGS. 2 and 3, sun gear 30 is formed integrally with an inner periphery on a front face side of guide plate 24.

Planetary gear 33 is rotatably supported by a carrier plate 32 fixed to the front end portion of spacer 8.

Ring gear 31 is formed on an inner periphery of an annular rotor 34 that is rotatably supported by an outer side of carrier plate 32.

Carrier plate 32 is fitted with the front end portion of spacer 8 and is fastened to be fixed to camshaft 134 by inserting a bolt 9 therethrough while contacting with a washer 37 at a front end portion thereof.

A braking plate 35 having a front facing braking face 35*b* is screwed in a front end surface of rotor 34.

Further, a braking plate 36 having a front facing braking face 36*b* is fixed, by welding or fitting, to an outer periphery of guide plate 24 integrally formed with sun gear 30.

Accordingly, in planetary gear mechanism 25, if planetary gear 33 is not rotated but is revolved together with carrier plate 32, in a condition where first and second electromagnetic brakes 26 and 27 are not operated, sun gear 30 and ring gear 31 are in free conditions to be rotated at the same speed.

If only first electromagnetic brake 26 is operated from the above condition, guide plate 24 is relatively rotated in a direction to be retarded with respect to carrier plate 32 (direction opposite to the R direction in FIGS. 4 and 5), so that drive plate 2 and camshaft 134 are relatively displaced in the advance direction shown in FIG. 5.

On the other hand, if only second electromagnetic brake 27 is operated from the above condition, a braking force is given to link gear 31 only, so that ring gear 31 is relatively rotated in a direction to be retarded with respect to carrier plate 32.

Thus, planetary gear 33 is rotated, and the rotation of planetary gear 33 increases a speed of sun gear 30, so that guide plate 24 is relatively rotated to the rotation direction R side with respect to drive plate 2.

Then, drive plate 2 and camshaft 134 are relatively rotated in the retarded direction shown in FIG. 4.

First and second electromagnetic brakes 26 and 27 are arranged in double on the inner and outer sides so as to face braking faces 36*b* and 35*b* of braking plates 36 and 35, respectively, and include cylinder members 26*r* and 27*r* that are supported by pins 26*p* and 27*p* on a rear surface of cover 6, in floating states where only the rotation thereof are restricted by pins 26*p* and 27*p*.

These cylinder members 26*r* and 27*r* house therein coils 26*c* and 27*c*, respectively, and are also respectively mounted with friction members 26*b* and 27*b* that are pressed to braking faces 35*b* and 36*b* when power is supplied to each of coils 26*c* and 27*c*.

Cylinder members 26*r* and 27*r*, and braking plates 35 and 36 are formed of magnetic substance, such as iron, for generating a magnetic field when the power is supplied to each of coils 26*c* and 27*c*.

On the contrary, cover 6 is formed of non-magnetic substance, such as aluminum, for preventing leakage of magnetic flux at the time of power supply, and friction members 26*b* and 27*b* are formed of non-magnetic substance, such as aluminum, for preventing from being made to be permanent magnet, to be attached to braking plate 35 and 36 at the time of non-power supply.

The relative rotation of drive plate 2 and guide plate 24 provided with sun gear 30 as an output element of planetary gear mechanism 25 is restricted by an assembling angle stopper 60 at a most retarded position and a most advance position.

Further, in planetary gear mechanism 25, braking plate 35 is formed integrally with ring gear 31 and also a planetary gear stopper 90 is disposed between braking plate 35 and carrier plate 32.

Operation conversion mechanism 40 described above is constituted such that a position of cylinder portion 14*a* of link arm 14 is maintained so that a relative assembling position between drive plate 2 and camshaft 134 does not fluctuate. Such a constitution will be described.

A driving torque is transmitted via link arm 14 and spacer 8 to camshaft 134 from drive plate 2.

While, a fluctuating torque of camshaft 134 due to a reaction force from intake valve 105 is input from camshaft 134 to link arm 14, as a force F of a direction to connect pivoting points on both ends of link arm 14.

Since cylinder portion 14*a* of link arm 14 is guided in radial along guide groove 2*g*, and also sphere 22 protruding forwards from cylinder portion 14*a* is fitted with spiral guide groove 28, the force F input via each link arm 14 is supported by the left and right walls of guide groove 2*g* and spiral guide groove 28 of guide plate 24.

Accordingly, the force F input to link arm 14 is divided into two components FA and FB orthogonal to each other, and these components FA and FB are received in directions orthogonal to a wall on the outer periphery of spiral guide groove 28 and orthogonal to one wall of guide groove 2*g*, respectively.

Therefore, cylinder portion 14*a* of link arm 14 is prevented from transferring along guide groove 2*g*.

Therefore, after guide plate 24 is rotated by the braking forces of respective electromagnetic brakes 26 and 27, and link arm 14 is operated to rotate to a predetermined position, the position of link arm 14 is maintained and a rotation phase between drive plate 2 and camshaft 134 is held as it is.

Note, the force F is not limited to the one acting in the outer diameter direction, but may acts in the inner diameter direction opposite to the outer diameter direction. In such a case, components FA and FB are received in directions orthogonal to a wall on the inner periphery of spiral guide groove 28 and orthogonal to the other wall of guide groove 2*g*, respectively.

An operation of variable valve timing mechanism 113 will be described hereafter.

In the case where a rotation phase of camshaft 134 with respect to crankshaft is controlled to a retarded side, the power is supplied to second electromagnetic brake 27.

If the power is supplied to second electromagnetic brake 27, friction member 27*b* of second electromagnetic brake 27 frictionally contacts with brake plate 35, and a braking force is acted on ring gear 31 of planetary gear mechanism 35, so that sun gear 30 is increasingly rotated with the rotation of timing sprocket 3.

Guide plate 24 is rotated in the rotation direction R side with respect to drive plate 2 by the increase rotation of sun gear 30, and as a result, sphere 22 supported by link arm 14 transfers to the outer periphery side of spiral guide groove 28.

This transfer to the retarded side is restricted at the most retarded position shown in FIG. 4 by assembling angle stopper 60.

Further, as described above, in braking the rotation of ring gear 31 by second electromagnetic brake 27, the rotation of ring gear 31 is not restricted instantaneously but is braked while permitting the rotation of a predetermined amount. When an amount of the rotation reaches the predetermined amount, the rotation of ring gear 31 is restricted.

On the other hand, in the case where the assembling angle of camshaft 134 is displaced to the advance direction, the power is supplied to first electromagnetic brake 26.

Thereby, the braking force acts on guide plate 24, and guide plate 24 is rotated in the direction opposite to rotation direction R with respect to drive plate 2, so that the assembling angle of camshaft 134 is changed to the advance side.

This displacement to the advance side is restricted at the most advance position shown in FIG. 5 by assembling angle stopper 60.

Further, when the rotation of guide plate 24 is restricted, planetary gear 33 is rotated and ring gear 31 is increasingly rotated. However, when the amount of the rotation of ring gear 31 reaches the predetermined amount, the rotation of sun gear 31 is restricted by planetary gear stopper 90.

Engine control unit 114 sets a target advance value of camshaft 134 and feedback controls the power supply to first and second electromagnetic brakes 26 and 27 based on a deviation between the target advance value and an actual advance value detected based on detection signals from crank angle sensor 117 and cam sensor 132.

Then, engine control unit 114 stops the power supply to both electromagnetic brakes 26 and 27 when the actual advance value coincides with the target advance value, to maintain the advance angle position at that time.

Figure 6:
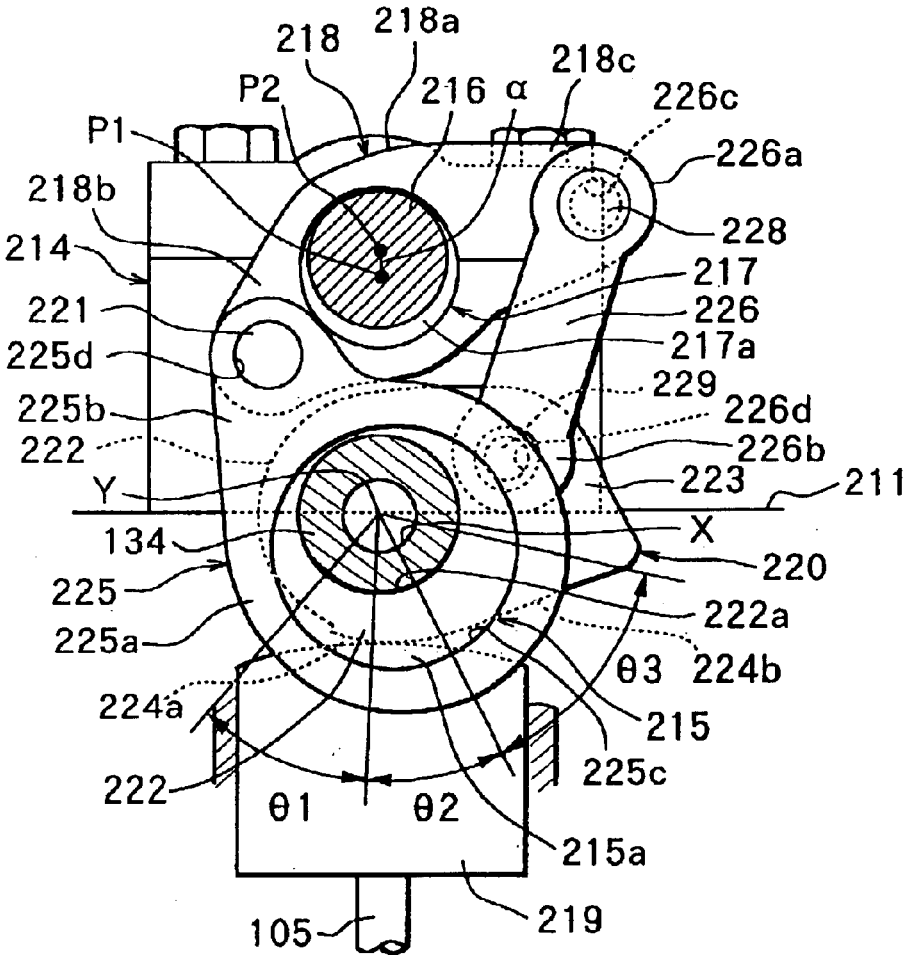
FIG. 6 is a cross section view showing a variable valve lift mechanism in the embodiment.
Figure 7:
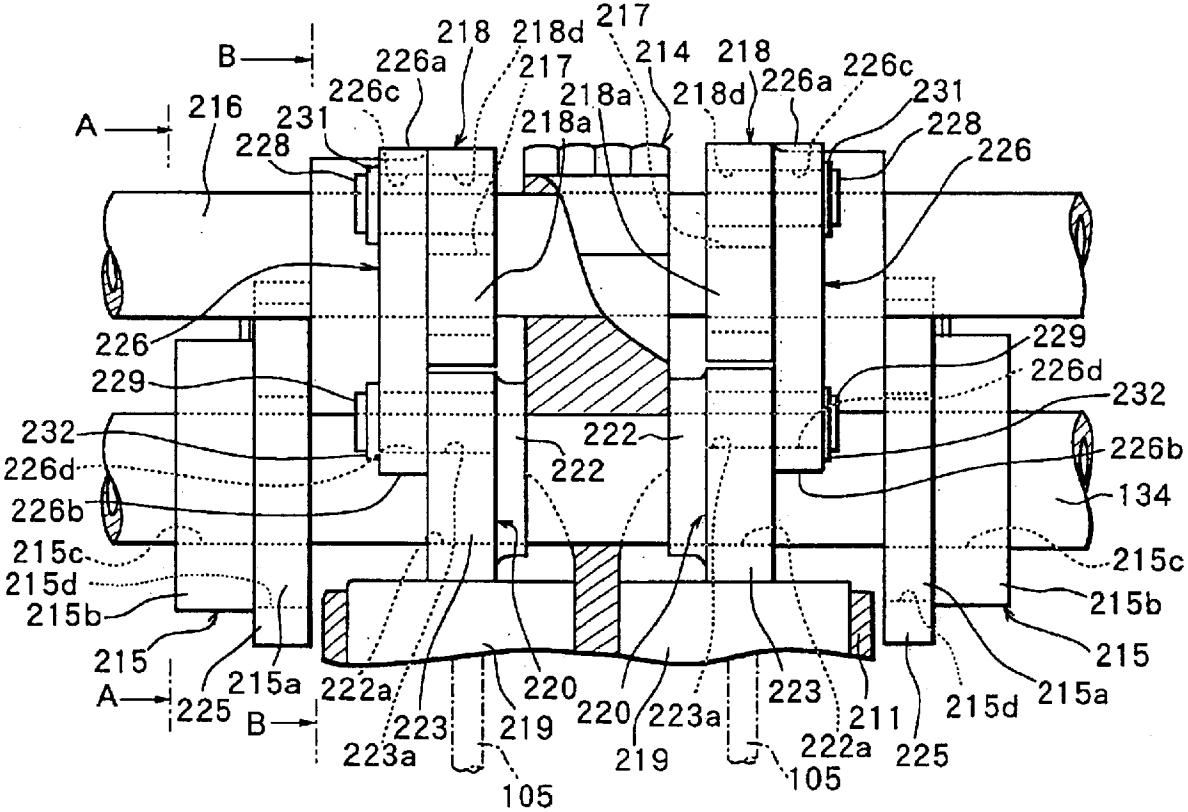
FIG. 7 is a side elevation view of the variable valve lift mechanism.
Figure 8:
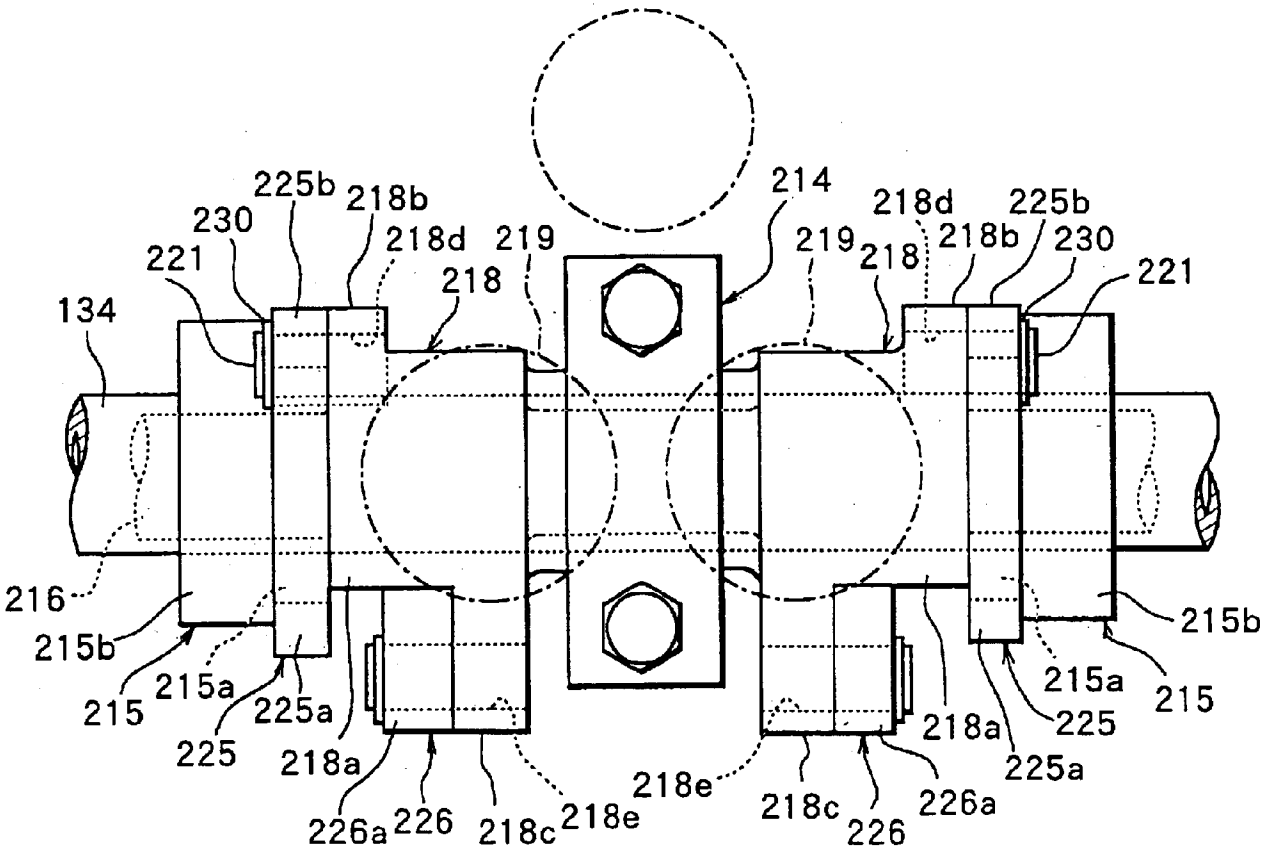
FIG. 8 is a top plan view of the variable valve lift mechanism.

FIG. 6 to FIG. 8 show in detail the structure of variable valve lift mechanism 112.

Variable valve lift mechanism has such a constitution as disclosed in Japanese Unexamined Patent Publication No. 2000-282901 in that an operating angle of a control shaft is changed so that a valve lift amount is continuously changed accompanying with a change in valve operating angle.

Variable valve lift mechanism 112 shown in FIG. 6 to FIG. 8 includes a pair of intake valves 105, 105, a hollow camshaft (drive shaft) 134 rotatably supported by a cam bearing 214 of a cylinder head 211, two eccentric cams (drive cams) 215, 215 as rotating cams axially supported by camshaft 134, a control shaft 216 rotatably supported by cam bearing 214 and arranged at an upper position of camshaft 134, a pair of rocker arms 218, 218 swingingly supported by control shaft 216 through a control cam 217, and a pair of independent swing cams 220, 220 disposed to upper end portions of intake valves 105,105 through valve lifters 219, 219, respectively.

Eccentric cams 215, 215 are connected with rocker arms 218, 218 by link arms 225, 225, respectively. Rocker arms 218, 218 are connected with swing cams 220, 220 by link members 226, 226.

Rocker arms 218, 218, link arms 225, 225, and link members 226, 226 constitute a transmission mechanism.

Figure 9:
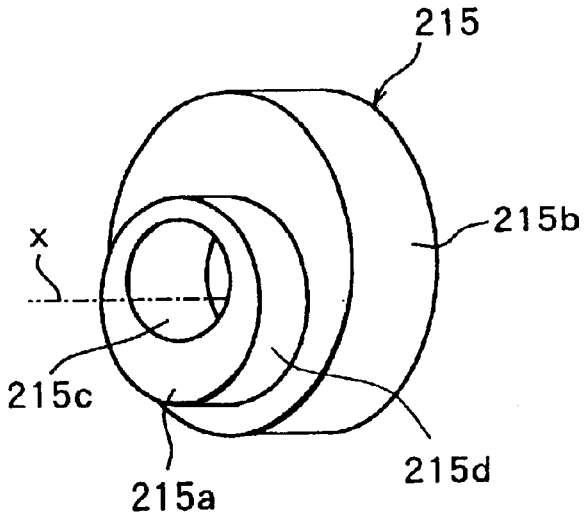
FIG. 9 is a perspective view showing an eccentric cam for use in the variable valve lift mechanism.

Each eccentric cam 215, as shown in FIG. 9, is formed in a substantially ring shape and includes a cam body 215*a* of small diameter, a flange portion 215*b* integrally formed on an outer surface of cam body 215*a*. A camshaft insertion hole 215*c* is formed through the interior of eccentric cam 215 in an axial direction, and also a center axis X of cam body 215*a* is biased from a center axis Y of camshaft 134 by a predetermined amount.

Eccentric cams 215, 215 are pressed and fixed to camshaft 134 via camshaft insertion holes 215*c* at outside positions that do not interfere with valve lifters 219, 219, respectively. Also, outer peripheral surfaces 215*d*, 215*d* of cam body 215*a* are formed in the same cam profile.

Each rocker arm 218, as shown in FIG. 8, is bent and formed in a substantially crank shape, and a central base portion 218*a* thereof is rotatably supported by control cam 217.

A pin hole 218*d* is formed through one end portion 218*b* which is formed to protrude from an outer end portion of base portion 218*a*. A pin 221 to be connected with a tip portion of link arm 225 is pressed into pin hole 218*d*. On the other hand, a pin hole 218*e* is formed through the other end portion 218*c* which is formed to protrude from an inner end portion of base portion 218*a*. A pin 228 to be connected with one end portion 226*a* (to be described later) of each link member 226 is pressed into pin hole 218*e*.

Control cam 217 is formed in a cylindrical shape and fixed to a periphery of control shaft 216. As shown in FIG. 6, a center axis P1 position of control cam 217 is biased from a center axis P2 position of control shaft 216 by $\alpha$.

Figure 10:
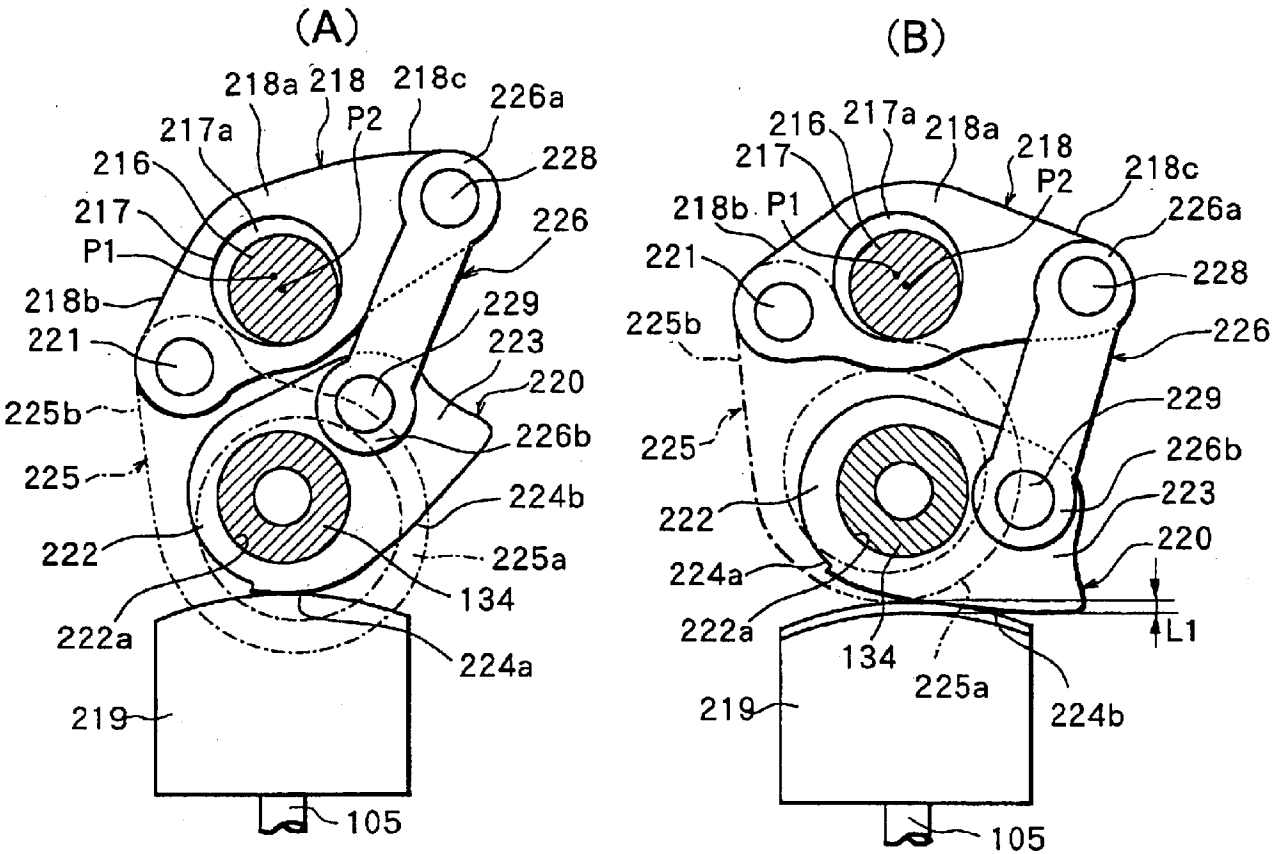
FIG. 10 is a cross section view showing a low lift control condition of engine valve by the variable valve lift mechanism.
Figure 11:
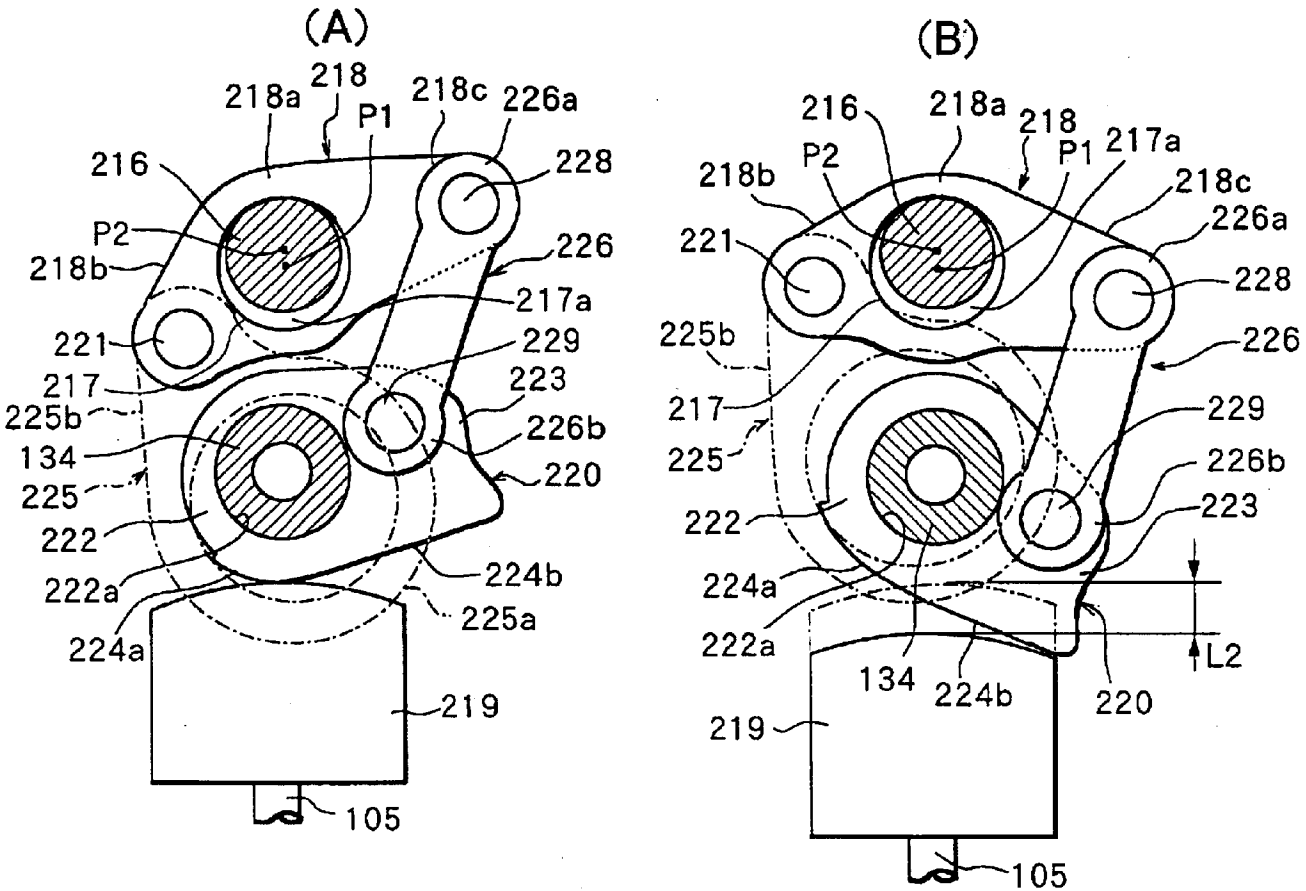
FIG. 11 is a cross section view showing a high lift control condition of the engine valve by the variable valve lift mechanism.

Swing cam 220 is formed in a substantially lateral U-shape as shown in FIG. 6, FIG. 10 and FIG. 11, and a supporting hole 222*a* is formed through a substantially ring-shaped base end portion 222. Camshaft 134 is inserted into supporting hole 222*a* to be rotatably supported. Also, a pin hole 223*a* is formed through an end portion 223 positioned at the other end portion 218*c* of rocker arm 218.

A base circular surface 224*a* of base end portion 222 side and a cam surface 224*b* extending in an arc shape from base circular surface 224*a* to an edge of end portion 223, are formed on a bottom surface of swing cam 220. Base circular surface 224*a* and cam surface 224*b* are in contact with a predetermined position of an upper surface of each valve lifter 219 corresponding to a swing position of swing cam 220.

Link arm 225 includes a ring-shaped base portion 225*a* and a protrusion end 225*b* protrudingly formed on a predetermined position of an outer surface of base portion 225*a*. A fitting hole 225*c* to be rotatably fitted with the outer surface of cam body 215*a* of eccentric cam 215 is formed on a central position of base portion 225*a*. Also, a pin hole 225*d* into which pin 221 is rotatably inserted is formed through protrusion end 225*b*.

Link member 226 is formed in a linear shape of predetermined length and pin insertion holes 226*c*, 226*d* are formed through both circular end portions 226*a*, 226*b*. End portions of pins 228, 229 pressed into pin hole 218*d* of the other end portion 218*c* of rocker arm 218 and pin hole 223*a* of end portion 223 of swing cam 220, respectively, are rotatably inserted into pin insertion holes 226*c*, 226*d*.

Snap rings 230, 231, 232 restricting axial transfer of link arm 225 and link member 226 are disposed on respective end portions of pins 221, 228, 229.

In such a constitution, depending on a positional relation between the center axis P2 of control shaft 216 and the center axis P1 of control cam 217, as shown in FIG. 10 and FIG. 11, a valve lift amount is changed, and by driving control shaft 216 to rotate, the position of the center axis P2 of control shaft 216 relative to the center axis P1 of control cam 217 is changed.

Control shaft 216 is driven to rotate by a DC servo motor (not shown in the figures). By changing an operating angle of control shaft 216 by the DC servo motor, the valve lift amount of each of intake valves 105, 105 is continuously changed, which accompanies a change in valve operating angle.

Control shaft 216 is provided with a potentiometer type operating angle sensor (not shown in the figures) detecting the operating angle. Control unit 114 feedback controls the DC servo motor so that an actual operating angle detected by operating angle sensor coincides with a target operating angle.

However, variable valve lift mechanism is not limited to the above constitution, but may be of such a constitution, for example, wherein the valve lift amount is switched by the switching of a cam to be used to open or close a valve.

Incidentally, in variable valve timing mechanism 113, as described above, the fluctuation torque of camshaft 134 due to the reaction force from intake valve 105 is received in the directions orthogonal to the wall on the outer periphery side of spiral guide groove 28 and orthogonal to the one wall of guide groove 2*g*.

Then, such an input torque from camshaft 134 becomes a resistance (load) of when relatively rotating guide plate 24, and therefore, a response characteristic in valve timing control is affected by the magnitude of input torque.

Figure 12:
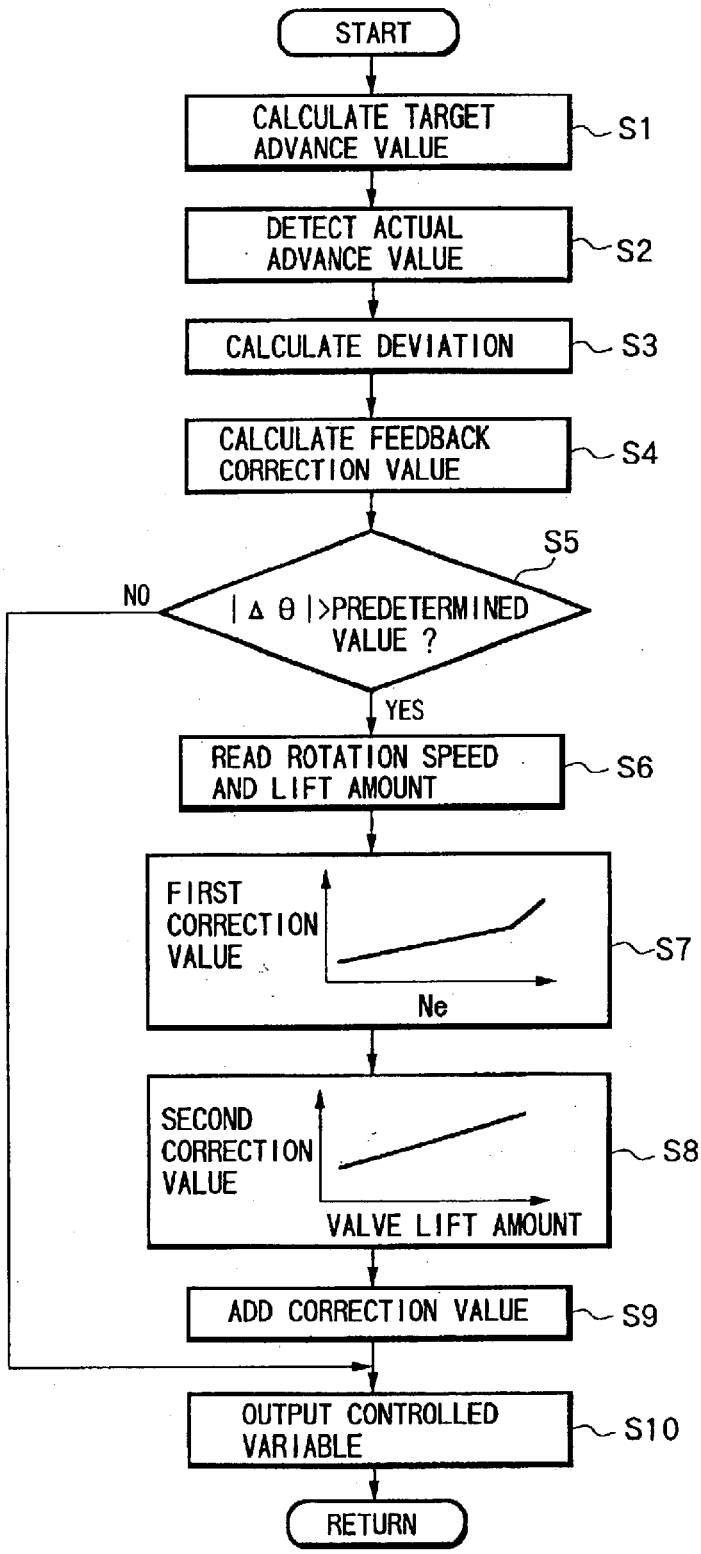
FIG. 12 is a flowchart showing a first embodiment of a valve timing control.

Here, engine control unit 114 controls variable valve timing mechanism 113 in accordance with a control program shown in a flowchart of FIG. 12, in order to maintain a desired response characteristic in the valve timing control.

In the flowchart of FIG. 12, in step S1, the target advance value of camshaft 134 is calculated.

In step S2, the actual advance value is detected based on detection signals from crank angle sensor 117 and cam sensor 112.

In step S3, a deviation θ between the target advance value and the actual advance value is calculated.

In step S4, a feedback power supply controlled variable is set by a proportional/integral/derivative control based on the deviation θ.

In step S5, it is judged whether or not an absolute value of the deviation θ exceeds a predetermined value.

If the absolute value of the deviation θ is the predetermined value or less, and reaches approximately the target advance value, it is judged that it is unnecessary to perform a correction according to the reaction force input from camshaft 134 side, and control proceeds to step S10.

In the case where control proceeded from step S5 to step S10, electromagnetic brakes 26 and 27 are controlled based on the feedback power supply controlled variable set in step S4.

On the other hand, if the absolute value of the deviation θ exceeds the predetermined value, it is judged that it is necessary to perform the correction according to the reaction force input from camshaft 134, and control proceeds to step S6.

The reaction force input from camshaft 134 side acts in approximately orthogonal to the wall of the outer periphery side of spiral guide groove 28. Especially, this reaction force becomes a large resistance when guide plate 24 and link arm 14 start to be relatively rotated from a condition where they are integrally rotated, and affects largely the response characteristic as the angle for relatively rotating guide plate 24 becomes larger.

In step S6, an engine rotation speed Ne and the operating angle (valve lift amount) of control shaft 216 of variable valve lift mechanism 112 are read out.

In step S7, a first correction value for correcting the power supply controlled variable is set according to the engine rotation speed Ne.

The first correction value corrects the power supply amount largely as the engine rotation speed Ne is higher, to increase magnetic forces (braking forces) generated by electromagnetic brakes 26 and 27.

This is because, when the engine rotation speed Ne is high, accompanying with this, the reaction force input from camshaft 134 side becomes larger.

Further, in step S8, a second correction value for correcting the power supply controlled variable is set according to the valve lift amount by variable valve lift mechanism 112.

The second correction value corrects the power supply amount largely as the valve lift amount is larger, to increase the magnetic forces (braking forces) generated by electromagnetic brakes 26 and 27.

This is because, when the valve lift amount is large, accompanying with this, the reaction force input from camshaft 134 side becomes larger.

In step S9, the first and second correction values are added to the feedback power supply controlled variable, to set the adding result as a final power supply controlled variable.

Then, in step S10, the power supply to each of electromagnetic brakes 26 and 27 is controlled according to the corrected power supply controlled variable.

According to the above constitution, if the input torque from camshaft 134 side is large and the load of when relatively rotating guide brake 24 by friction braking becomes larger, the magnetic forces (braking forces) generated by electromagnetic brakes 26 and 27 are increased. Therefore, when the input torque from camshaft 134 side is large, it is possible to avoid reduction in feedback response characteristic of valve timing.

Note, if there is not provided variable valve lift mechanism 112, the control of step S8 may be omitted to perform only the correction according to the engine rotation speed Ne.

Also, the feedback control is not limited to the proportional/integral/derivative control, but for example, a sliding mode control may be used.

Moreover, a correction function according to the input torque from camshaft 134 side may be provided as a control program or as a semiconductor circuit.

Figure 13:
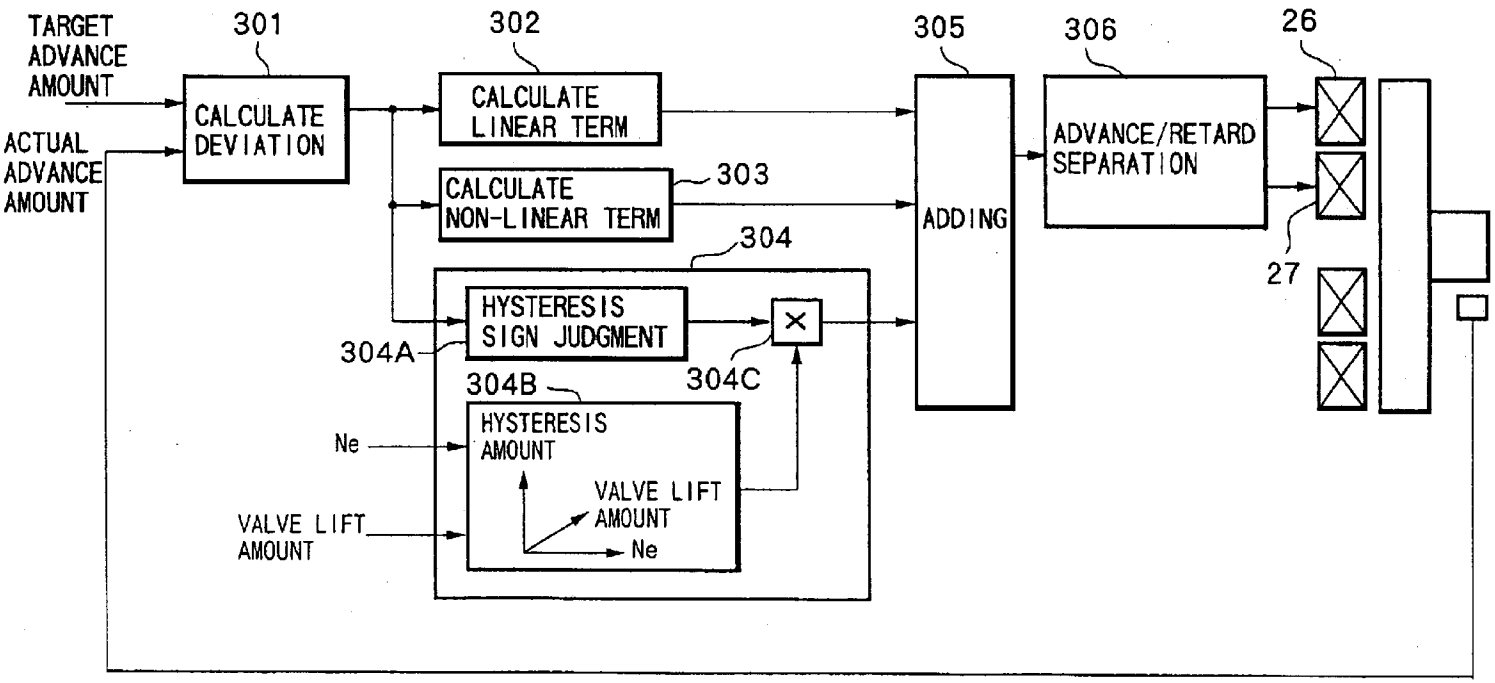
FIG. 13 is a circuitry block diagram showing a second embodiment of the valve timing control.

A circuitry block diagram in FIG. 13 shows a second embodiment of the control of variable valve timing mechanism 113.

In this second embodiment, the valve timing is controlled by the sliding mode control.

In FIG. 13, a deviation calculating section 301 is input with the target advance value and the actual advance value, and calculates the deviation $\Delta\theta$ between the target advance value and the actual advance value.

The deviation $\Delta\theta$ is output to a linear term calculating section 302, a non-linear term calculating section 303, and a hysteresis calculating section 304, respectively.

Linear term calculating section 302 calculates a proportional component based on the deviation $\Delta\theta$, and a speed correction component according to a derivative value of the actual advance value, to calculate, based on these components, a linear term consisting the power supply controlled variable.

Non-linear term calculating section 303 calculates a non-linear term consisting the power supply controlled variable, based on a switching function S defined based on the deviation $\Delta\theta$ and a derivative value $\Delta\Delta\theta$ of the deviation $\Delta\theta$ as a system state variable.

The switching function S is defined using a coefficient y as;

$S=\gamma\cdot\Delta\theta+\Delta\Delta\theta$, and the non-linear term is calculated using a coefficient K and a chattering prevention coefficient $\delta$ as;

$$\text{non-linear term}=K\cdot S/(|S|+\delta.$$

Hysteresis calculating section 304 is input with the engine rotation speed Ne and the valve lift amount controlled by variable valve lift mechanism 112, in addition to the deviation $\Delta\theta$.

A sign judging section 304A of hysteresis calculating section 304, generates a signal indicating whether or not it is necessary to perform the correction according to the input torque from camshaft 134 side based on the absolute value and sign of the deviation $\Delta\theta$.

Here, if the absolute value of the deviation $\Delta\theta$ is a predetermined value or above, and it is an advance control time for transferring sphere 22 supported by link arm 14 to the inner periphery side of spiral guide groove 28, it is judged that the correction is necessary and "1" is output. In the case other than the above, "0" is output.

At the advance control time, a rotation load of guide plate 24 due to the input torque from camshaft 134 side is increasingly changed, and the response characteristic is largely reduced compared to the retarded time.

A hysteresis correction value calculating section 304B of hysteresis calculating section 304 calculates a hysteresis correction value according to the engine rotation speed Ne and the valve lift amount.

The hysteresis correction value is set to be larger as the engine rotation speed Ne is high, or as the valve lift amount is large.

That is, a hysteresis characteristic in the valve timing control is previously modeled for each input torque from camshaft 134 side, and in order to improve the response characteristic in the direction where the response characteristic is lower, the hysteresis correction value is adopted for each engine rotation speed Ne and each valve lift amount, that are correlative to the input torque.

A signal from hysteresis sign judging section 304A and the hysteresis correction value from hysteresis correction value calculating section 304B are output to an adder 304C. Only when the signal from hysteresis sign judging section 304B is "1", the hysteresis correction value is output.

Adder 305 sums up the linear term, the non-linear term and the hysteresis correction value, to output the summing result to a divider 306 as the power supply controlled variable.

Divider 306 supplies the power to either electromagnetic brake 26 or electromagnetic brake 27 based on the power controlled variable from adder 305.

Note, the function for judging whether or not it is necessary to perform the correction based on the control direction may be added to the first embodiment shown in the flowchart of FIG. 12, as a control program.

Further, in this embodiment, the constitution has been described such that the relative rotation of guide plate 24 in the advance direction and the retarded direction is performed using two electromagnetic brakes 26 and 27. However, the constitution may be such that there is disposed an electromagnetic brake that gives a rotation resistance to guide plate 24, while urging guide plate 24 to the retarded direction by a resilient body (for example, a spiral spring), to advance camshaft 1 according to a braking force of the electromagnetic brake.

Moreover, the correction control of the electromagnetic brakes according to the input torque from camshaft side can be widely adopted to a variable valve timing mechanism constituted to change the rotation phase of the camshaft with respect to the crankshaft by the braking forces of the electromagnetic brakes.

The entire contents of Japanese Patent Application No. 2002-007921 filed on Jan. 16, 2002, a priority of which is claimed, are incorporated herein by reference.

While only selected embodiments have been chosen to illustrate the present invention, it will be apparent to those skilled in the art from this disclosure that various changes and modifications can be made herein without departing from the scope of the invention as defined in the appended claims.

Furthermore, the foregoing description of the embodiments according to the present invention is provided for illustration only, and not for the purpose of limiting the invention as defined in the appended claims and their equivalents.

What is claimed is:

1. A control apparatus of a variable valve timing mechanism that changes a rotation phase of a camshaft with respect to a crankshaft by a braking force of an electromagnetic brake to vary valve timing of engine valves, comprising:

an input torque detector that detects an input torque from a camshaft side to said variable valve timing mechanism; and a control unit that calculates a controlled variable of said electromagnetic brake according to a target value of said rotation phase, and also calculates a correction value of said controlled variable based on said input torque, and corrects said controlled variable with said correction value to obtain a corrected controlled variable, to control said electromagnetic brake based on said corrected controlled variable.

2. A control apparatus of a variable valve timing mechanism according to claim 1, wherein said control unit;

calculates said correction value based on a hysteresis characteristic that is previously modeled for each input torque from said camshaft side.

3. A control apparatus of a variable valve timing mechanism according to claim 1, wherein said control unit;

judges whether or not it is necessary to perform a correction according to said input torque, according to a direction to change said rotation phase.

4. A control apparatus of a variable valve timing mechanism according to claim 1, wherein said control unit;

calculates a feedback controlled variable of said electromagnetic brake based on a deviation between the target value of said rotation phase and an actual rotation phase, to add said correction value according to said input torque to said feedback controlled variable.

5. A control apparatus of a variable valve timing mechanism according to claim 4, wherein said control unit;

adds the correction value according to said input torque only when an absolute value of said deviation exceeds a predetermined value.

6. A control apparatus of a variable valve timing mechanism according to claim 1, wherein said input torque detector detects a rotation speed of an engine as a state amount correlative to said input torque, and said, control unit corrects said controlled variable of said electromagnetic brake according to the target value of said rotation phase with a correction value according to the rotation speed of the engine.

7. A control apparatus of a variable valve timing mechanism according to claim 1, wherein there is further provided a variable valve lift mechanism that changes a valve lift amount of said engine valves, said input torque detector detects the valve lift amount of said engine valves and a rotation speed of an engine, as state amounts correlative to said input torque, and said control unit corrects said controlled variable of said electromagnetic brake according to the target value of said rotation phase with a correction value according to said valve lift amount and the rotation speed of the engine.

8. A control apparatus of a variable valve timing mechanism according to claim 1, wherein there is further provided a variable valve lift mechanism that changes a valve lift amount of said engine valves, said input torque detector detects the valve lift amount of said engine valves as a state amount correlative to said input torque, and said control unit corrects said controlled variable of said electromagnetic brake according to the target value of said rotation speed with a correction value according to said valve lift amount.

9. A control apparatus of a variable valve timing mechanism according to claim 8, wherein said variable valve lift mechanism comprises:

a driving shaft rotated synchronously with said camshaft;

a drive cam fixed to said driving shaft;

a swing cam opening/closing said engine valves;

a transmission mechanism connected with said driving cam side at one end thereof and connected with said swing cam side at the other end;

a control shaft including a control cam that changes a position of said transmission mechanism; and an actuator rotating said control shaft, wherein said control shaft is rotated by said actuator to continuously change a valve lift amount.

10. A control apparatus of a variable valve timing mechanism according to claim 1, wherein said variable valve timing mechanism is constituted so that:

a driving rotor on the crankshaft side and a driven rotor on the camshaft side are coaxially connected with each other via a link arm;

one end of said link arm is connected with either said driving rotor or said driven rotor so as to be movable in a radial direction; and a guide plate formed thereon with a spiral guide groove, with which the one end of said link arm is fitted, wherein said guide plate is relatively rotated with respect to said driving rotor by said electromagnetic brake and which causes the one end of said link arm to move in the radial direction, to change an assembling angle between said driving rotor and said driven rotor.

11. A control apparatus of a variable valve timing mechanism that changes a rotation phase of a camshaft with respect to a crankshaft by a braking force of an electromagnetic brake to vary valve timing of engine valves, comprising:

input torque detecting means for detecting an input torque from a camshaft side to said variable valve timing mechanism;

target value calculating means for calculating a target value of said rotation phase;

controlled variable calculating means for calculating a controlled variable of said electromagnetic brake based on said target value;

correction amount calculating means for calculating a correction value of said controlled variable of said electromagnetic brake based on said input torque;

correcting means for correcting said controlled variable with said correction amount; and control means for controlling said electromagnetic brake based on said corrected controlled variable.

12. A control method of a variable valve timing mechanism that changes a rotation phase of a camshaft with respect to a crankshaft by a braking force of an electromagnetic brake to vary valve timing, of engine valves, comprising the steps of:

detecting an input torque from a camshaft side to said variable valve timing mechanism;

calculating a controlled variable of said electromagnetic brake based on a target value of said rotation phase;

calculating a correction value of said controlled variable based on said input torque;

correcting said controlled variable with said correction amount; and controlling said electromagnetic brake based on said corrected controlled variable.

13. A control method of a variable valve timing mechanism according to claim 12, wherein said step of calculating said correction amount comprises the step of;

calculating a correction value based on a hysteresis characteristic that is previously modeled for each input torque from said camshaft side.

14. A control method of a variable valve timing mechanism according to claim 12, wherein said step of correcting said controlled variable with said correction amount comprises the step of;

judging whether or not it is necessary to perform a correction according to said input torque from said camshaft side, according to a direction to change said rotation phase.

15. A control method of a variable valve timing mechanism according to claim 12, wherein said step of calculating said controlled variable based on said target value comprises the step of:

detecting the rotation phase of said camshaft with respect to said crankshaft;

calculating a deviation between the target value of said rotation phase and an actual rotation phase; and calculating said controlled variable based on said deviation.

16. A control method of a variable valve timing mechanism according to claim 15, wherein said step of correcting said controlled variable with said correction value comprises the steps of:

comparing an absolute value of said deviation with a predetermined value; and correcting said controlled variable with said correction value only when said absolute value of said deviation exceeds said predetermined value.

17. A control method of a variable valve timing mechanism according to claim 12, wherein said step of detecting said input torque comprises the step of;

detecting a rotation speed of an engine as a state amount correlative to said input torque.

18. A control method of a variable valve timing mechanism according to claim 12, wherein said step of detecting said input torque comprises the steps of:

detecting a valve lift amount of said engine valves as a state amount correlative to said input torque; and detecting a rotation speed of said engine as a state amount correlative to said input torque.

19. A control method of a variable valve timing mechanism according to claim 12, wherein said step of detecting said input torque comprises the step of:

detecting a valve lift amount of said engine valves as a state amount correlative to said input torque.

20. A control method of a variable valve timing mechanism that changes a rotation phase of a camshaft with respect to a crankshaft by a braking force of an electromagnetic brake to vary valve timing of engine valves, comprising the steps of:

calculating a target value of said rotation phase;

detecting said rotation phase;

calculating a deviation between said target value and said detected rotation phase;

calculating a controlled variable of said electromagnetic brake based on said deviation;

detecting a rotation speed of an engine;

detecting a valve lift amount to be variably controlled of said engine valves calculating a correction value of said controlled variable based on said engine rotation speed and said valve lift amount;

correcting said controlled variable with said correction amount; and controlling said electromagnetic brake based on said corrected controlled variable.

* * * * *